US008459786B2

(12) United States Patent
Ito

(10) Patent No.: US 8,459,786 B2
(45) Date of Patent: Jun. 11, 2013

(54) LIQUID EJECTING APPARATUS FOR ELIMINATING AND SUPPRESSING GENERATION OF AIR BUBBLES

(75) Inventor: Hiroyuki Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 387 days.

(21) Appl. No.: 12/543,632

(22) Filed: Aug. 19, 2009

(65) Prior Publication Data

US 2010/0053283 A1 Mar. 4, 2010

(30) Foreign Application Priority Data

Aug. 29, 2008 (JP) ..... 2008-220831

(51) Int. Cl.
*B41J 2/19* (2006.01)
*B41J 2/175* (2006.01)

(52) U.S. Cl.
USPC ..... 347/92; 347/85

(58) Field of Classification Search
USPC ..... 347/92
See application file for complete search history.

(56) References Cited

U.S. PATENT DOCUMENTS

| | | | | |
|---|---|---|---|---|
| 6,059,405 | A | 5/2000 | Mochizuki et al. | |
| 6,478,415 | B2 * | 11/2002 | Barinaga et al. | 347/85 |
| 7,195,335 | B2 | 3/2007 | Usui | |
| 7,473,302 | B2 | 1/2009 | Ueda | |
| 2007/0052782 | A1 * | 3/2007 | Lee | 347/97 |
| 2008/0151026 | A1 * | 6/2008 | Kobayashi | 347/92 |
| 2008/0225090 | A1 * | 9/2008 | Kobayashi | 347/85 |
| 2008/0309706 | A1 * | 12/2008 | Yokouchi et al. | 347/30 |

FOREIGN PATENT DOCUMENTS

| | | |
|---|---|---|
| CN | 1796138 | 7/2006 |
| CN | 1267279 C | 8/2006 |
| JP | 11-042795 | 2/1999 |
| JP | 11-048491 | 2/1999 |
| JP | 2006-075683 | 3/2006 |
| JP | 2008-173789 | 7/2008 |

* cited by examiner

*Primary Examiner* — Shelby Fidler
(74) *Attorney, Agent, or Firm* — Workman Nydegger

(57) ABSTRACT

There is provided a liquid ejecting apparatus that is used for ejecting a liquid. The liquid ejecting apparatus includes a head unit that ejects the liquid, a liquid supply path that is used for directing the liquid to the head unit, a decompression defoaming unit that eliminates air bubbles from the liquid by decompressing at least a part of the liquid supply path, and a pressurizing unit that pressurizes at least a part of the liquid supply path.

6 Claims, 6 Drawing Sheets

THIRD EMBODIMENT

<AT THE TIME OF INK EJECTION (PUMP EJECTION)>

<AT THE TIME OF STOPPING SUPPLY OF INK (PUMP STOP)>

SECOND EMBODIMENT

THIRD EMBODIMENT

FOURTH EMBODIMENT

LIQUID EJECTING APPARATUS FOR ELIMINATING AND SUPPRESSING GENERATION OF AIR BUBBLES

BACKGROUND

The entire disclosure of Japanese Patent Application No. 2008-220831, filed Aug. 29, 2008, is expressly incorporated herein by reference.

TECHNICAL FIELD

The present invention relates to technology for eliminating air bubbles from a liquid located in a liquid supply path inside a liquid ejecting apparatus or for suppressing the generation of the air bubbles.

RELATED ART

In ink jet printers, there are cases where defective printing, such as dot missing, occurs when air bubbles are generated in ink located in an ink supply path, that is from an ink supply unit, such as from an ink cartridge to a record head. Thus, printers capable of eliminating the air bubbles (defoaming) from ink have been proposed (see JP-A-2006-75683).

However, according to a general defoaming method, there are problems that air bubbles contained in the ink cannot be sufficiently eliminated and the growth of the air bubbles cannot be sufficiently suppressed. In addition, such problems may occur not only in ink jet printers but also in liquid ejecting apparatuses that eject any type of liquid such as a lubricant or a resin liquid.

SUMMARY

An advantage of some aspects of the invention is that it provides a liquid ejecting apparatus capable of eliminating air bubbles from a liquid therein and suppressing the generation of the air bubbles.

The invention may be implemented in the following forms or applied examples.

Applied Example 1

According to a first aspect of the invention, there is provided a liquid ejecting apparatus that is used for ejecting a liquid. The liquid ejecting apparatus includes: a head unit that ejects the liquid; a liquid supply path that is used for directing the liquid to the head unit; a decompression defoaming unit that eliminates air bubbles from the liquid by decompressing at least a part of the liquid supply path; and a pressurizing unit that pressurizes at least a part of the liquid supply path.

According to the above-described liquid ejecting apparatus, the liquid is decompressed and defoamed in at least a part of the liquid supply path by the decompression defoaming unit, and accordingly, the air bubbles contained in the liquid can be eliminated. In addition, the liquid is pressurized by the pressurizing unit, and accordingly, the air bubbles contained in the liquid can be eliminated, and the growth of the air bubbles can be suppressed.

Applied Example 2

In the liquid ejecting apparatus described in Applied Example 1, the decompression defoaming unit includes a defoaming chamber that is used for eliminating the air bubbles contained in the liquid, a decompression chamber that is brought into contact with the defoaming chamber, and a pressure adjusting section that adjusts the pressure of the inside of the decompression chamber, and gas can be permeated through a wall of the defoaming chamber that is brought into contact with the decompression chamber and a wall of the decompression chamber that is brought into contact with the defoaming chamber.

Accordingly, the air bubbles contained in the liquid that are collected in the defoaming chamber can be discharged to the decompression chamber through the wall of the defoaming chamber that is brought into contact with the decompression chamber and the wall of the decompression chamber that is brought into contact with the defoaming chamber.

Applied Example 3

In the liquid ejecting apparatus described in Applied Example 2, the wall of the defoaming chamber that is brought into contact with the decompression chamber and the wall of the decompression chamber that is brought into contact with the defoaming chamber are integrally formed.

Accordingly, the number of components can be decreased, compared to a configuration in which the wall of the defoaming chamber that is brought into contact with the decompression chamber and the wall of the decompression chamber that is brought into contact with the defoaming chamber are formed as separate bodies. As a result, the manufacturing cost of the liquid ejecting apparatus can be suppressed.

Applied Example 4

The liquid ejecting apparatus described in Applied Example 2 further includes a valve device that can seal the liquid supply path, and the valve device is disposed on the downstream side relative to the defoaming chamber.

Accordingly, the liquid can be pressurized, decompressed, and defoamed in the defoaming chamber altogether. Therefore, a great amount of air bubbles can be eliminated within a short time.

Applied Example 5

In the liquid ejecting apparatus described in Applied Example 1, the liquid supply path includes a decompression defoaming area that is decompressed and defoamed by the decompression defoaming unit and a pressurized area that is pressurized by the pressurizing unit.

Accordingly, decompression and defoaming can be performed in the decompression defoaming area after the elimination of the air bubbles and the suppression of the growth of the air bubbles have been performed in the pressurized area, and therefore, a mechanism that is used for decompression and defoaming can be miniaturized. Alternatively, the ink can be pressurized in the pressurized area after the air bubbles are eliminated in the decompression defoaming area, and accordingly, a mechanism that is used for pressurizing the ink can be miniaturized.

Applied Example 6

The liquid ejecting apparatus described in Applied Example 1 further includes a pump mechanism, and the decompression defoaming unit and the pressurizing unit commonly use the pump mechanism.

Accordingly, the number of components can be decreased, compared to a configuration in which the decompression defoaming unit and the pressurizing unit respectively include a pump mechanism. As a result, the manufacturing cost of the liquid ejecting apparatus can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

A1. Configuration of Apparatus

Figure 1:
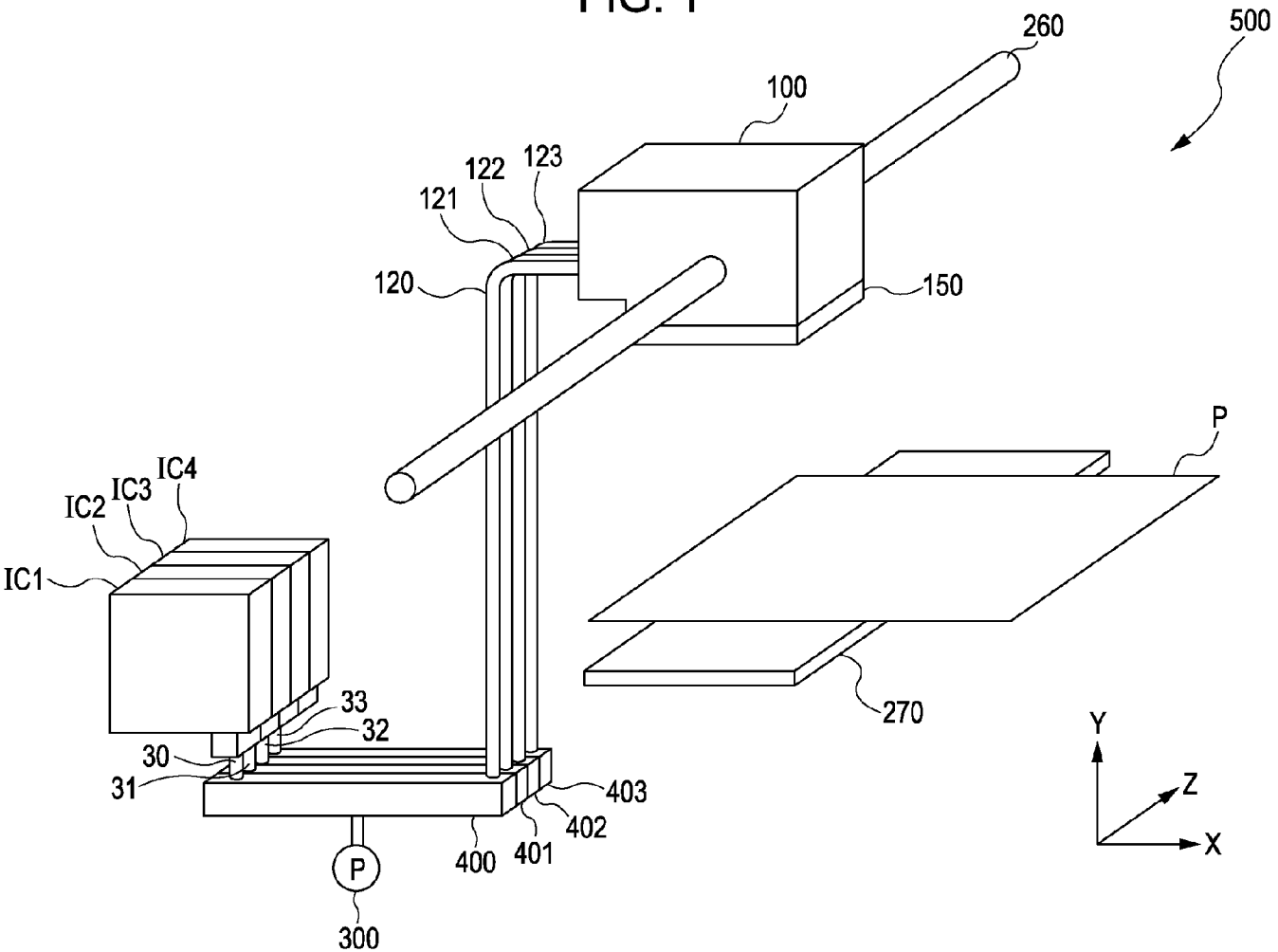
FIG. 1 is an explanatory diagram showing a schematic configuration of a printer as a liquid ejecting apparatus according to a first embodiment of the invention.

FIG. 1 is an explanatory diagram showing a schematic configuration of a printer 500 as a liquid ejecting apparatus according to a first embodiment of the invention. The printer 500 according to the first embodiment is an ink jet printer that can eject four-colors (black, cyan, magenta, and yellow) of ink. This printer 500 includes an ink cartridge IC1 for black ink, an ink cartridge IC2 for cyan ink, an ink cartridge IC3 for magenta ink, an ink cartridge IC4 for yellow ink, a carriage 100, a record head 150, a guide rod 260, a platen 270, four ink supply units 400, 401, 402, and 403, four ink deriving tubes 30, 31, 32, and 33, four distribution tubes 120, 121, 122, and 123, and a negative-pressure generating chamber 300.

The printer 500 is a so-called off-carriage-type printer in which four ink cartridges IC1 to IC4 are mounted to the printer main body side. The ink cartridge IC1 is connected to the carriage 100 through the ink deriving tube 30, the ink supply unit 400, and the distribution tube 120. Similarly, the ink cartridges IC2, IC3, IC4 are connected to the carriage 100 through the ink deriving tube 31, the ink supply unit 401, and the distribution tube 121, through the ink deriving tube 32, the ink supply unit 402, and the distribution tube 122, and through the ink deriving tube 33, the ink supply unit 403, and the distribution tube 123. In addition, the ink cartridges IC1 to IC4 are mounted on a main frame (not shown) of the printer 500 by a cartridge holder not shown in the figure.

The ink supply unit 400 supplies black ink stored in the ink cartridge IC1 to the carriage 100 through the distribution tube 120. Similarly, the ink supply units 401, 402, and 403 supply cyan ink, magenta ink, and yellow ink that are stored in the ink cartridges IC2, IC3, and IC4 to the carriage 100.

The negative-pressure generating unit 300 is connected to four ink supply units 400 to 403. The ink supply units 400 to 403 use the negative-pressure generating unit 300 for supplying ink of each color to the carriage 100. In addition, the negative-pressure generating unit 300 is also used for supplying negative pressure to the carriage 100. Inside the four distribution tubes 120 to 123, an ink flow path and a negative-pressure supplying path (not shown) are disposed.

The guide rod 260 is disposed on the upper side (+Y direction) of the platen 270 along the longitudinal direction (the Z axis) of the platen 270. The carriage 100 is supported to be able to reciprocate in the direction of the Z axis along the guide rod 260. In addition, the carriage 100 is driven through a timing belt (not shown) by a carriage motor (not shown). The record head 150 is disposed on the bottom face of the carriage 100. In addition, the record head 150 ejects ink droplets in the −Y direction from a plurality of nozzles (not shown) in accompaniment with a reciprocating motion of the carriage 100. At this moment, a recording sheet P is sent on the platen 270 in the +X direction by a paper feeding mechanism not shown in the figure, and an image, or the like, is formed on the recording sheet P.

Figure 2:
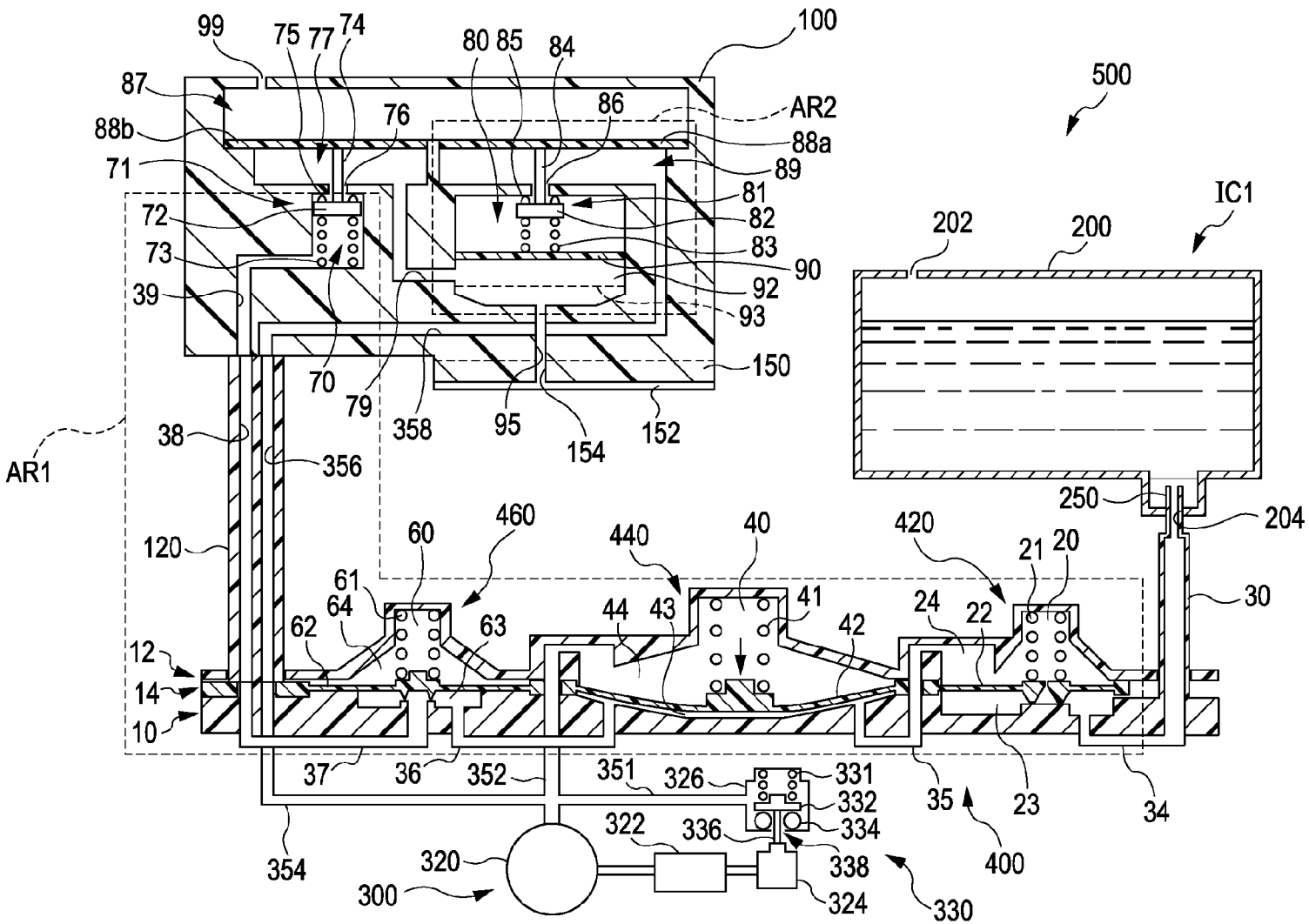
FIG. 2 is a cross-sectional view showing the internal structure of a printer shown in FIG. 1.

FIG. 2 is a cross-sectional view showing the internal structure of the printer 500 shown in FIG. 1. In the example shown in FIG. 2, the internal structure relating to the supply of black ink is shown. However, the internal structure relating to the supply of ink of a different color is the same. In the example shown in FIG. 2, for the convenience of drawing, the relative positional relationship between the carriage 100 and the ink cartridge IC1 and the directions of the carriage 100 and the ink cartridge IC1 are represented differently from those shown in FIG. 1. In addition, the state shown in FIG. 2 is the state right after the replacement of an old black ink cartridge with a new ink cartridge IC1.

The ink cartridge IC1 has a hollow case 200 and stores black ink therein. The case 200 includes an atmospheric communication hole 202 disposed on the upper face and an ink supply opening 204 disposed on the lower face. The atmospheric communication hole 202 applies the atmospheric pressure to the liquid surface of the black ink stored in the case 200 by allowing the inside of the case 200 and the atmosphere to communicate with each other. Into the ink supply opening 204, an ink deriving needle 250 disposed on the front end of the ink deriving tube 30 is inserted. The ink deriving needle 250 supplies the black ink stored in the case 200 to the ink supply unit 400.

The ink supply unit 400 includes a first flow path forming member 10, a second flow path forming member 12, and a flexible member 14. The first flow path forming member 10 and the second flow path forming member 12 are separate members that are formed from resins. In addition, the flexible member 14 is a separate plate-shaped member that is formed from rubber. The first flow path forming member 10, the second flow path forming member 12, and the flexible member 14 are stacked together. Alternatively, as the first flow path forming member 10 and the second flow path forming member 12, members that are formed from metal may be used. Furthermore, as the flexible member 14, a member formed from a resin may be used. The ink supply unit 400 that has the above-described configuration includes a first valve 420, a second valve 460, and a pump 440.

The first valve 420 includes a first valve chamber 20, a valve body 22, and a coil spring 21. The first valve chamber 20 is a convex-shaped space that is formed between the first flow path forming member 10 and the second flow path forming member 12. The valve body 22 is disposed inside the first valve chamber 20 and forms a lower space 23 and an upper space 24 in the first valve chamber 20. The valve body 22 is a part of the flexible member 14 and can be displaced inside the first valve chamber 20 in the vertical direction. In the state in which ink is not supplied, the valve body 22 is pressed by the first flow path forming member 10 in accordance with the biasing force of the coil spring 21. This state is a valve closing state. In this state, the first valve 420 blocks the flow of ink from the ink cartridge IC1 to the pump 440. On the other hand, when the valve body 22 is displaced to the upper side, a communication hole is formed in the center portion, and the valve body 22 is in the valve opening state, whereby the first valve 420 can allow the ink to pass through it. The upper space 24 is communicated with the internal flow path 35. The internal flow path 35 is an ink flow path that connects the first valve chamber 20 and a pump chamber 40 to be described later. The lower space 23 is communicated with the internal flow path 34. The internal flow path 34 is an ink flow path that connects the ink deriving tube 30 and the first valve chamber 20.

The pump 440 includes the pump chamber 40, a diaphragm 42, and a coil spring 41. Similarly to the above-described first valve chamber 20, the pump chamber 40 is a convex-shaped space that is formed between the first flow path forming member 10 and the second flow path forming member 12. The diaphragm 42 is disposed inside the pump chamber 40 and divides the pump chamber 40 into a lower space 43 and an upper space 44. The diaphragm 42 is a part of the flexible member 14 and can be displaced inside the pump chamber 40 in the vertical direction. When the diaphragm 42 is displaced to the upper side, ink is sucked from the ink cartridge IC1 through the first valve 420. On the other hand, when the diaphragm 42 is displaced to the lower side, ink is supplied to the carriage 100 through the second valve 460. In the example shown in FIG. 2, the diaphragm 42 is positioned to the lowest side (the lowest point). In addition, the lower space 43 is communicated with two internal flow paths 35 and 36. The internal flow path 36 is an ink flow path that connects the pump chamber 40 and a second valve chamber 60 to be described later. The upper space 44 is connected to a negative-pressure supplying path 352 to be described later.

The second valve 460 includes a second valve chamber 60, a valve body 62, and a coil spring 61. Similarly to the first valve chamber 20, the second valve chamber 60 is a convex-shaped space that is formed between the first flow path forming member 10 and the second flow path forming member 12. The valve body 62 is disposed inside the second valve chamber 60. The valve body 62 that forms a lower space 63 and an upper space 64 in the second valve chamber 60 is a part of the flexible member 14 and can be displaced inside the second valve chamber 60 in the vertical direction. In the state in which ink is not supplied, the valve body 62 is pressed by the first flow path forming member 10 in accordance with the biasing force of the coil spring 61. This state is a valve closing state. In this state, the second valve 460 blocks the flow of ink from the pump 440 to the distribution tube 120 (the carriage 100). On the other hand, when receiving pressure equal to or higher than a predetermined pressure (for example, 13 kPa) towards the upper side from the ink located inside the internal flow path 36, the valve body 62 is displaced to the upper side so as to be in the valve opening state. At this moment, the second valve 460 can allow the ink to pass through it. The lower space 63 is communicated with the internal flow paths 36 and 37.

The negative-pressure generating unit 300 includes a driving motor 322, a suction pump 320, a cam mechanism 324, and an atmosphere opening mechanism 330. The suction pump 320 is connected to the driving motor 322. In addition, the suction pump 320 is connected to negative-pressure supplying paths 352 and 354. The driving motor 322 is connected to the suction pump 320 and the cam mechanism 324 and drives the suction pump 320 and the cam mechanism 324. The atmosphere opening mechanism 330 includes a casing 326, a coil spring 331, a valve body 332, and a sealing member 334. The casing 326 is connected to the negative-pressure supplying paths 352 and 354 through the distribution tube 351. In addition, an opening portion 338 is formed in the casing 326, and a rod 336 is inserted into the opening portion 338. Between the opening portion 338 and the rod 336, a gap is formed. The rod 336 is bonded to the valve body 332 inside the casing 326. The coil spring 331 is biased in the direction in which the valve body 332 is pressed toward the sealing member 334. The above-described driving motor 322 can be driven to rotate forward or driven to rotate backward. The suction pump 320 is driven in accordance with forward rotation driving of the driving motor 322 so as to generate negative pressure. On the other hand, the cam mechanism 324 is driven in accordance with reverse rotation driving of the driving motor 322 so as to push the rod 336 away. At this moment, the valve body 332 is lifted up to be apart from the sealing member 334. Accordingly, the inside of the casing 326 is opened to the atmosphere, and the negative-pressure supplying paths 352 and 354 are also opened to the atmosphere.

Inside the distribution tube 120, an internal flow path 38 and a negative-pressure supplying path 356 are disposed. The internal flow path 38 is communicated with the internal flow path 37 so as to form an ink supply path. In addition, the negative-pressure supplying path 356 is communicated with the negative-pressure supplying path 358 so as to form a negative-pressure supplying path. The distribution tube 120 is configured by a rubber tube, or the like, so as to respond to the reciprocating motion of the carriage 100 in the printing operation.

The carriage 100 includes an atmospheric chamber 87, a first compression chamber 77, a second compression chamber 89, a third valve 71, a decompression chamber 80, a defoaming chamber 92, an atmospheric pressure valve 81, two internal flow paths 39 and 79, the negative-pressure supplying path 358, and an ink ejecting flow path 95.

The atmospheric chamber 87 is communicated with the atmosphere through the atmosphere communication hole 99. The first compression chamber 77 is a hollow chamber. The first compression chamber 77 adjusts the pressure of the ink supply path inside the carriage 100 by temporarily collecting black ink. The first compression chamber 77 is adjacent to the atmospheric chamber 87 through a partition wall portion 88*b* as a ceiling portion. The partition wall portion 88*b* has flexibility and can be displaced in the vertical direction. The partition wall portion 88*b* may be configured by a film, for example, formed of a synthetic resin, rubber, or the like, and a thin plate member of a cantilever (not shown) that can be displaced with the film. The first compression chamber 77 includes an ink inflow opening 76 and is communicated with the valve chamber 70 to be described later through the ink inflow opening 76. In addition, the first compression chamber 77 is communicated with a defoaming chamber 92 through the internal flow path 79.

The third valve 71 includes the valve chamber 70, a valve body 72, a pressure adjusting spring 73, a sealing member 75, and a support rod 74. The valve chamber 70 is a hollow chamber and is communicated with the internal flow path 39. The valve body 72 is disposed inside the valve chamber 70 and is biased to the sealing position side by the pressure adjusting spring 73. The valve body 72 can be displaced between an opening position in which the first compression chamber 77 and the valve chamber 70 are communicated with each other and a sealing position in which the first compression chamber 77 and the valve chamber 70 are not communicated with each other. In particular, when a force pressing down on the valve body 72 (suppressed pressure of the support rod 74 generated by the partition wall portion 88*b* and the pressure inside the first compression chamber 77) becomes stronger than a force lifting up the valve body 72 (the pressure inside the valve chamber 70 and the biasing force of the pressure adjusting spring 73), the valve body 72 is displaced toward the opening position. On the other hand, when the force pressing down the valve body 72 becomes weaker than the force lifting up the valve body 72, the valve body 72 is displaced toward the sealing position. In addition, in the example shown in FIG. 2, the valve body 72 is located in the sealing position. The sealing member 75 is disposed on the top face of the valve body 72. The sealing member 75 seals ink so as not to flow from the valve chamber 70 to the first compression chamber 77, in a case where the valve body 72 is disposed in the sealing position. The support rod 74 is disposed over the valve chamber 70 and the first compression chamber 77. The support rod 74 has one end bonded to the valve body 72 and the other end bonded to the partition wall portion 88*b* of the first compression chamber 77.

The defoaming chamber 92 is a hollow chamber and includes a filter 93 therein. The defoaming chamber 92 is communicated with the internal flow path 79 on the upper portion side relative to the filter 93 and temporarily stores ink that has flown in from the internal flow path 79 for performing a defoaming operation to be described later. The ink stored in the defoaming chamber 92 passes through the filter 93 and is discharged to the ink ejecting flow path 95 that is communicated with the bottom face of the defoaming chamber 92. The filter 93 has the function of capturing (trapping) the air bubbles in the ceiling portion of the defoaming chamber 92 by having the air bubbles flowing inside the ink supply path so as to not easily pass through the ink supply path together with eliminating impurities (dusts or the like) by filtering the ink.

The decompression chamber 80 is a hollow chamber that is disposed on the upper side of the defoaming chamber 92 and is used for eliminating gas (air bubbles) from the defoaming chamber 92 by using negative pressure that is supplied from the negative-pressure generating unit 300. The floor face of the decompression chamber 80 and the ceiling face of the defoaming chamber 92 are integrally formed as the partition wall portion 90. This partition wall portion 90 is formed from a member (for example, polyacetal, polypropylene, polyphenylene ether, or the like) that has gas permeability. Alternatively, instead of using the integrally formed partition wall portion 90, a configuration in which the floor face of the decompression chamber 80 and the ceiling face of the defoaming chamber 92 are formed as separate walls having gas permeability and are brought into contact with each other may be used.

The second compression chamber 89 is a hollow chamber that is disposed on the upper side of the decompression chamber 80. The second compression chamber 89 is used for supplying the negative pressure, which is supplied from the negative-pressure generating unit 300, to the decompression chamber 80. The second compression chamber 89 is located adjacent to the atmospheric chamber 87 through a partition wall portion 88*a* as a ceiling portion. In addition, the partition wall portion 88*a* has the same configuration as the above-described partition wall portion 88*b*. However, the partition wall portion 88*a* and the partition wall portion 88*b* can be independently displaced without being brought into contact with each other. The second compression chamber 89 is communicated with the negative-pressure supplying path 358. In addition, the negative-pressure supplying path 358 is communicated with the negative-pressure supplying path 356. In addition, the second compression chamber 89 is communicated with the decompression chamber 80 through a communication hole 86. The atmospheric pressure valve 81 is disposed over the second compression chamber 89 and the decompression chamber 80. This atmospheric pressure valve 81 has the same configuration as the above-described third valve 71. In other words, the atmospheric pressure valve 81 includes a valve body 82, a pressure adjusting spring 83, a sealing member 85, and a support rod 84. The valve body 82 can be displaced between an opening position in which the second compression chamber 89 and the decompression chamber 80 are communicated with each other and a sealing position in which the second compression chamber 89 and the decompression chamber 80 are not communicated with each other. The valve body 82 is biased to the sealing position side by the pressure adjusting spring 83. In the example shown in FIG. 2, the valve body 82 is disposed in the sealing position. The sealing member 85 maintains negative pressure inside the decompression chamber 80 by sealing the communication hole 86 in a case where the valve body 82 is disposed in the sealing position. The support rod 84 has one end bonded to the valve body 82 and the other end bonded to a partition wall portion 88*a*.

The record head 150 is disposed on the bottom face of the carriage 100. This record head 150 includes a nozzle plate 152 and an ink ejecting flow path 154. The ink ejecting flow path 154 is communicated with the ink ejecting flow path 95 of the carriage 100 and directs the ink supplied and ejected from the defoaming chamber 92 to the nozzle plate 152. The nozzle plate 152 includes a plurality of nozzles (not shown) and ejects ink that has been supplied from the defoaming chamber 92 through the ink ejecting flow path 95 and the ink ejecting flow path 154.

The above-described defoaming chamber 92, the decompression chamber 80, the atmospheric pressure valve 81, the second compression chamber 89, and the negative-pressure generating unit 300 correspond to the decompression defoaming unit according to an embodiment of the invention. In addition, the pump 440 and the negative-pressure generating unit 300 correspond to the pressurizing unit according to an embodiment of the invention. The suction pump 320, the third valve 71, and the negative-pressure generating unit 300 correspond to the pressure adjusting section, the valve device, and the pump mechanism according to an embodiment of the invention.

A2. Ink Supplying Operation of Ink Supply Unit 400

Figure 3A:
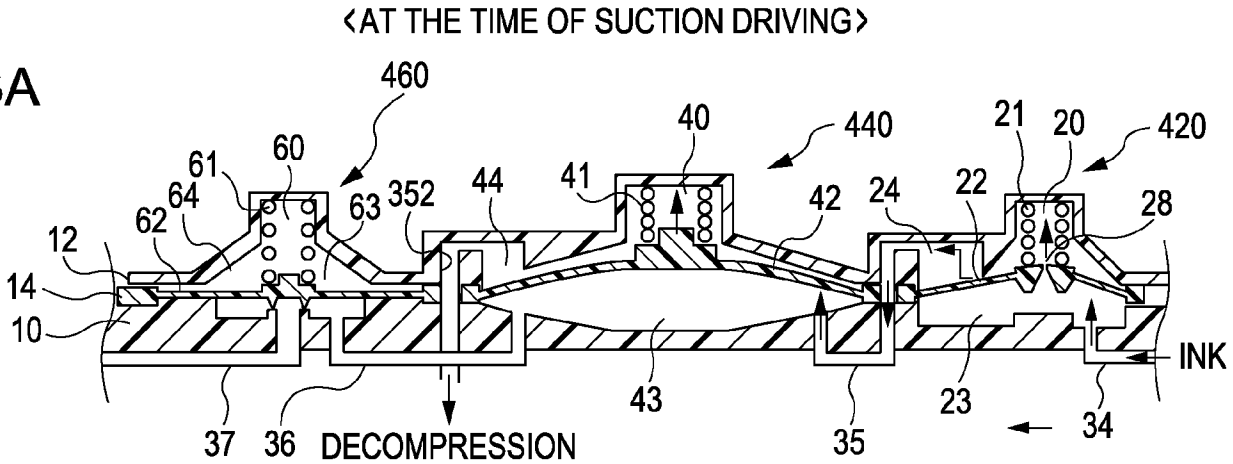
FIG. 3A is a cross-sectional view showing an ink supply unit at the time of ink suction driving.
Figure 3B:
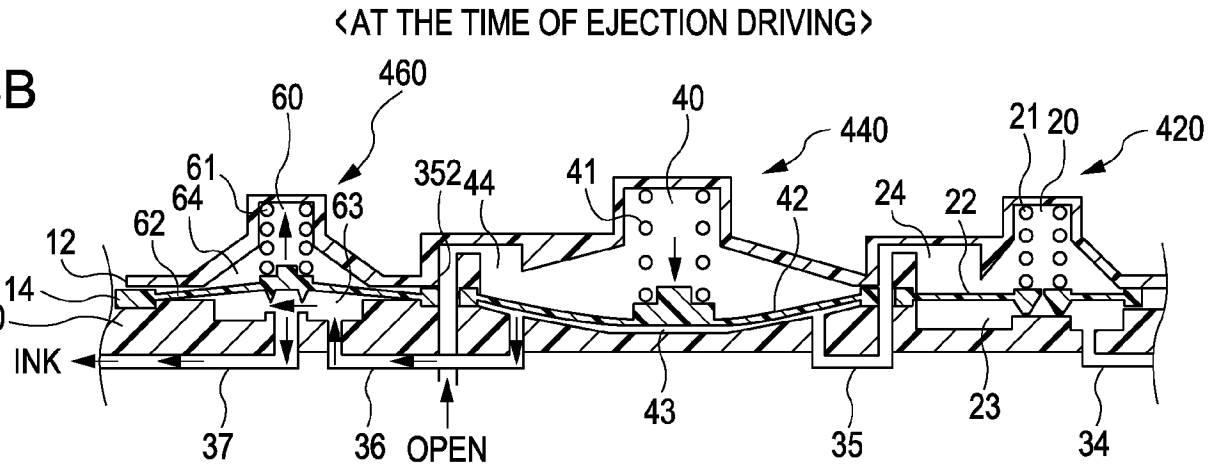
FIG. 3B is a cross-sectional view showing the ink supply unit at the time of ink ejection driving.

FIG. 3A is a cross-sectional view showing the ink supply unit 400 at the time of ink suction driving. FIG. 3B is a cross-sectional view showing the ink supply unit 400 at the time of ink ejection driving. When ink is to be supplied to the record head 150 from the state shown in FIG. 2, first, the pump 440 performs ink suction driving from the ink cartridge IC1.

In particular, the driving motor 322 (FIG. 2) drives the suction pump 320 by performing forward rotation driving. Then, the suction pump 320 generates negative pressure and supplies the negative pressure to the upper space 44 of the pump 440 through the negative-pressure supplying path 352 (FIG. 3A). When the inside of the upper space 44 becomes negative pressure, the diaphragm 42 is elastically deformed by overcoming the biasing force of the coil spring 41 so as to be displaced to the upper side, and, as shown in FIG. 3A, the volume of the lower space 43 increases. At this moment, since the inside of the lower space 43 becomes negative pressure, the pump performs a suction operation. In other words, the pump 440 sucks ink of the upper space 24 of the first valve 420 through the internal flow path 35. The valve body 22 of the first valve 420 is elastically deformed by overcoming the biasing force of the coil spring 21 so as to be displaced to the upper side. At this moment, a communication hole 28 that allows the upper space 24 and the lower space 23 to communicate with each other is generated in the center portion of the valve body 22, and the first valve 420 is in the valve opening state. Accordingly, the black ink stored in the ink cartridge IC1 (FIG. 2) passes through the ink deriving needle 250, the ink deriving tube 30, the internal flow path 34 (FIG. 3A), the lower space 23, the communication hole 28, the upper space 24, and the internal flow path 35 and is sucked in the lower space 43 of the pump 440 of which the volume has been increased.

On the other hand, in the second valve 460, the ink located inside the lower space 63 is sucked into the pump 440 through the internal flow path 36 at the time of the suction driving of the pump 440. Accordingly, the valve body 62 maintains the state (valve closing state) being pressed by the first flow path forming member 10.

After the ink is collected in the lower space 43 of the pump chamber 40 by the above-described suction driving, the pump 440 performs ink ejection driving. In particular, the driving motor 322 (FIG. 2) drives the cam mechanism 324 by performing reverse rotation driving. Then, the rod 336 is pushed away, and the valve body 332 is lifted up to be in the valve opening state, so that the distribution tube 351 is communicated with the atmosphere through the opening portion 338. At this moment, the upper space 44 is opened to the atmosphere though the negative-pressure supplying path 352 (FIG. 3B), and the diaphragm 42 is elastically deformed (displaced) to the lower side by the biasing force of the coil spring 41. The ink collected inside the lower space 43 is discharged to the internal flow paths 35 and 36 with predetermined pressure (for example, 30 kPa) in accordance with the displacement of the diaphragm 42. The pressurized ink that is discharged from the lower space 43 to the internal flow path 36 lifts up the valve body 62 of the second valve 460 from the lower side with a predetermined pressure (for example, 30 kPa). Then, the valve body 62 is displaced to the upper side by overcoming the biasing force (for example, 13 kPa) of the coil spring 61 to be in the valve opening state. Accordingly, the ink that has flowed into the lower space 63 is ejected to the carriage 100 through the internal flow path 37.

On the other hand, in the first valve 420, the pressurized ink flows into the upper space 24 through the internal flow path 35. Then, the valve body 22 is displaced to the lower side in accordance with the biasing force of the coil spring 21 and the pressure of the flowing ink. Accordingly, the communication hole 28 generated in the center portion of the valve body 22 disappears, so that the upper space 24 and the lower space 23 are not communicated with each other. Accordingly, it is suppressed that the pressurized ink ejected from the lower space 43, in accordance with the ejection driving of the pump 440, flows backward to the ink cartridge IC1 through the first valve 420.

After the above-described ejection driving is performed after the exchange of the ink cartridge, a predetermined pressure (for example, 30 kPa) is applied to the ink supply path between the pump 440 and the third valve 71. As described above, in the printer 500, a portion of the ink supply path between the ink cartridge IC1 and the record head 150, which is located between the ink supply unit 400 to the third valve 71, is set as a pressurization area AR1 (FIG. 2). Then, since the ink is pressurized in the pressurization area AR1, the growth of air bubbles contained in the ink is suppressed. In addition, in a case where the ink supply path (the internal flow paths 34 to 39 and the like) in the pressurization area is formed by a gas-permeable member, dissolution of gas into the ink from the atmosphere though the wall face of the ink supply path can be suppressed, and the gas dissolved in the ink can be eliminated through the wall face of the ink supply path.

When the ink is ejected from the record head 150 (FIG. 2), as described below, ink of the amount corresponding to the amount of ink consumption accompanied with the ink ejection is supplied to the record head 150 through the third valve 71 that is in the valve opening state. In addition, the ink of the amount corresponding to the amount of ink consumption is supplied to the carriage 100 by the pump 440 (FIG. 3B). At this moment, the ink is supplied in the state pressurized by the suppressed pressure (suppressed pressure on the basis of the biasing force of the coil spring 41) toward the lower side. Then, when the diaphragm 42 is displaced up to the position of the lowest point, the driving motor 322 performs the forward rotation driving again, and the pump 440 performs the suction driving and the ejection driving described above. Accordingly, the ink of the consumed amount is appropriately supplied from the ink cartridge IC1 to the record head 150 in the pressurized state.

A3. Ink Supplying Operation of Carriage 100

Figure 4A:
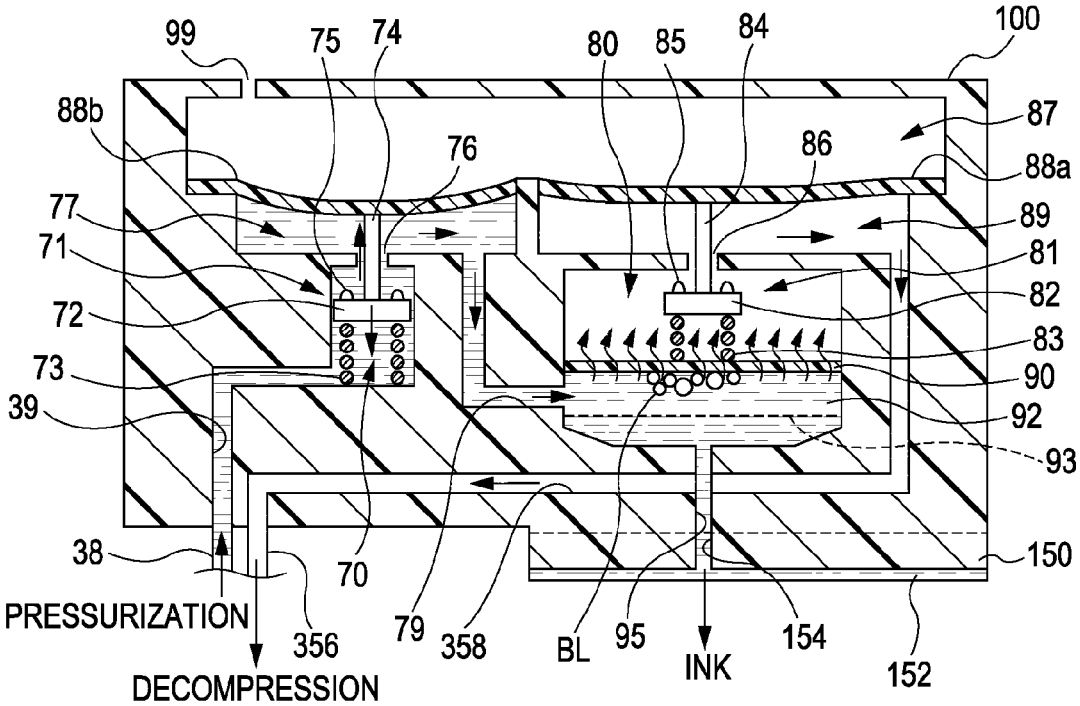
FIG. 4A is a cross-sectional view showing the state of a carriage and a record head at the time of ink ejection.

FIG. 4A is a cross-sectional view showing the state of the carriage 100 and the record head 150 at the time of ink ejection. When ink is consumed by being ejected from a plurality of nozzles (not shown) disposed in the nozzle plate 152, the chamber pressure of the first compression chamber 77 decreases due to a decrease in the amount of ink. Then, the partition wall portion 88*b* is bent toward the inside of the first pressure chamber 77 due to differential pressure between the decompressed chamber pressure and the pressure (the atmospheric pressure) of the atmospheric chamber 87 so as to be displaced to the lower side. At this moment, the valve body 72 is pressed downward through the support rod 74. Then, when the valve body 72 is located in the opening position by overcoming the biasing force of the pressure adjusting spring 73, the ink inflow opening 76 is opened, and accordingly, the ink flows into the first compression chamber 77.

Figure 4B:
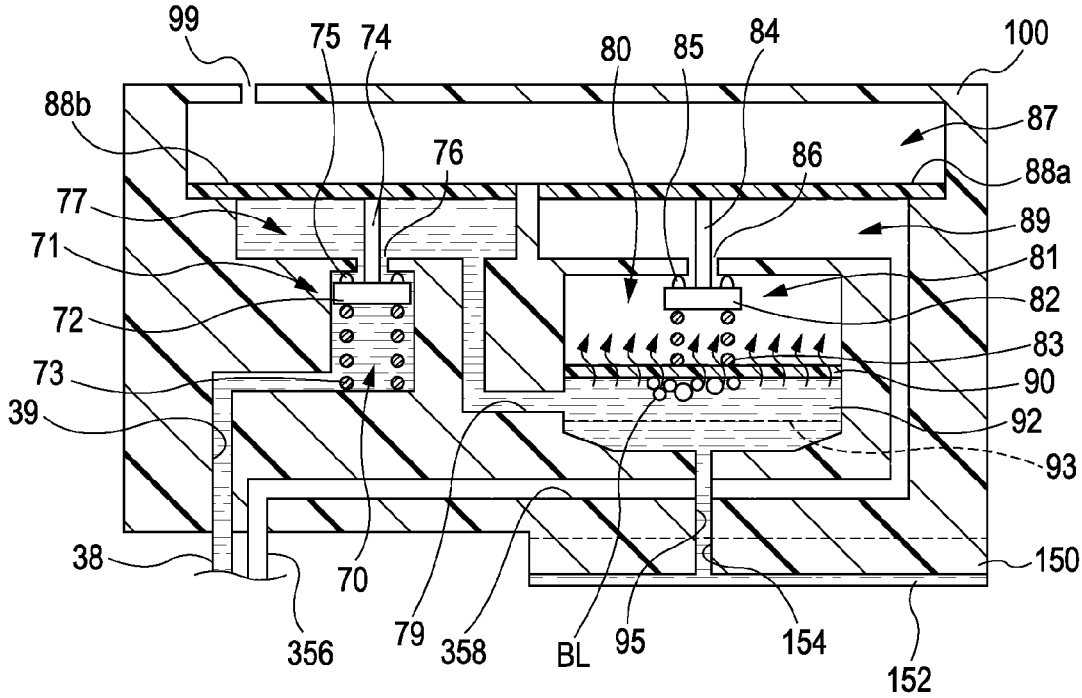
FIG. 4B is a cross-sectional view showing the state of the carriage and the record head after the ink flows into a first compression chamber from an opened ink inflow opening.

FIG. 4B is a cross-sectional view showing the state of the carriage 100 and the record head 150 after the ink flows into the first compression chamber 77 from the opened ink inflow opening 76. When the chamber pressure of the first compression chamber 77 is increased by having the ink flow into the first compression chamber 77, the partition wall portion 88*b* is displaced to the upper side. When the valve body 72 is moved to the sealing position again in accordance with the above-described displacement of the partition wall portion 88*b*, the inflow of ink into the first compression chamber 77 is stopped, and the supply of the ink to the record head 150 is stopped. As described above, the printer 500 is configured such that ink of the consumed amount appropriately flows into the record head 150 by opening or closing the third pressure-adjusting valve 71 in accordance with consumption of the ink.

A4. Defoaming Operation 1

The negative pressure generated by the suction pump 320 (FIG. 2), as described above, is supplied to the second compression chamber 89 (FIG. 4A) through the negative-pressure supplying paths 354, 356, and 358 while simultaneously being supplied to the upper space 44 of the pump 440. At this moment, the partition wall portion 88*a* is bent to the inside of the second compression chamber 89 so as to be displaced to the lower side due to a differential pressure between the chamber pressure (negative pressure) of the second compression chamber 89 and the pressure (atmospheric pressure) of the atmospheric chamber 87. The valve body 82 is pressed down through the support rod 84. Then, when the valve body 82 is located in the opening position, the communication hole 86 is opened, and the negative pressure is supplied to the decompression chamber 80. Then, the air bubbles (gas) BL that are trapped in the ceiling portion of the defoaming chamber 92 are transmitted through the partition wall portion 90 so as to flow into the decompression chamber 80 due to a differential pressure between the pressure inside the decompression chamber 80 and the pressure of the defoaming chamber 92, whereby the air bubbles are slowly decreased.

In addition, when the valve body 332 of the atmosphere opening mechanism 330 (FIG. 2) is in the valve opening state, and the second compression chamber 89 is opened to the atmosphere through the distribution tubes 351, 354, 356, and 358, the differential pressure between the second compression chamber 89 and the atmospheric chamber 87 disappears, and as shown in FIG. 4B, the partition wall portion 88*a* is displaced to the upper side. In accompaniment with the displacement of the partition wall portion 88*a*, the valve body 82 is displaced to the upper side so as to seal the communication hole 86. Accordingly, the negative pressure inside the atmospheric pressure valve 81 is maintained, and elimination of the gas in the defoaming chamber 92 is continuously performed.

As described above, in the printer 500, the decompression defoaming area AR2 (FIG. 2) is arranged in a portion of the ink supply path between the ink cartridge IC1 to the record head 150 that is located on the downstream side (the side closer to the record head 150) of the third valve 71. Then, the above-described defoaming operation is performed in the decompression defoaming area AR2, and accordingly, the gas contained in the ink is eliminated.

As described above, in the printer 500, the pressurization area AR1 and the decompression defoaming area AR2 are arranged, and the ink is pressurized and supplied in the pressurization area AR1, whereby the growth of the air bubbles contained in the ink or melting of ink into the ink can be suppressed. In addition, the defoaming operation is performed in the decompression defoaming area AR2, and accordingly, the air bubbles contained in the ink can be eliminated. As a result, the air bubbles contained in the ink flowing inside the printer 500 can be sufficiently eliminated, and the growth of the air bubbles can be sufficiently suppressed. In addition, since the ink that is in a state in which the amount of the air bubbles is decreased due to the pressurization is decompressed and defoamed, the defoaming chamber 92 used for stopping (trapping) the air bubbles can be miniaturized. In addition, the negative-pressure generating unit 300 and the ink supply unit 400 are commonly used for pressurizing, decompressing, and defoaming the ink, the manufacturing cost of the printer 500 can be suppressed, compared to a configuration in which the negative-pressure generating unit 300 and the ink supply unit 400 are separately arranged for each purpose.

B. Second Embodiment

Figure 5:
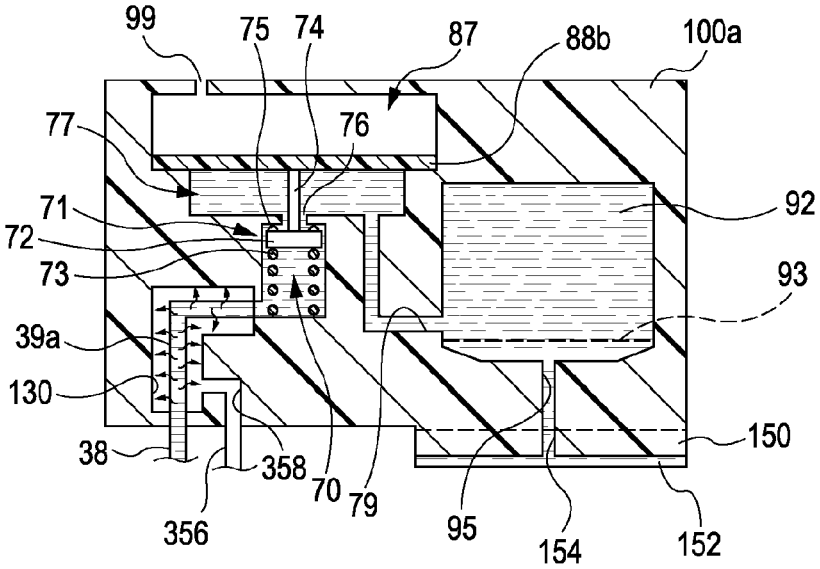
FIG. 5 is a cross-sectional view showing the internal structure of a carriage and a record head according to a second embodiment of the invention.

FIG. 5 is a cross-sectional view showing the internal structure of a carriage 100*a* and a record head 150 according to a second embodiment of the invention. A printer according to the second embodiment is different from the printer 500 (FIGS. 1 to 4) in the four points described below, and other configurations are the same as those according to the first embodiment. In other words, there are differences in that the carriage 100*a* does not include the second compression chamber 89, the partition wall portion 88*a*, the decompression chamber 80, the atmospheric pressure valve 81, and the partition wall portion 90, the carriage 100*a* has an internal flow path 39*a* instead of the internal flow path 39, the carriage 100*a* includes a decompression defoaming chamber 130, and a negative-pressure supplying path 358 is connected to the decompression defoaming chamber 130.

In the first embodiment, the pressurization of the ink and the decompressing and defoaming of the ink are performed in different areas (the pressurization area AR1 and the decompression defoaming area AR2). However, in the second embodiment, the pressurization and the decompression and defoaming are performed in an overlapping area. In particular, the decompression defoaming chamber 130 is installed so as to surround the internal flow path 39*a*, and the decompressing and defoaming are performed in the decompression defoaming chamber 130. However, the pressurization area of the second embodiment is the same (the zone from the ink supply unit 400 to the third valve 71) as those of the first embodiment. Accordingly, in the second embodiment, the pressurization and the decompressing and defoaming are performed together in the decompressing defoaming chamber 130.

The ink supplied to the internal flow path 39*a* (FIG. 5) from the ink supply unit 400 (FIG. 2) is pressurized in the same manner as in the first embodiment and can flow out of the internal flow path 39*a* that has external gas permeability. Here, negative pressure is supplied to the inside of the decompression defoaming chamber 130 through the negative-pressure supplying path 358. Accordingly, gas can easily flow out from the internal flow path 39*a* inside the decompression defoaming chamber 130.

According to the printer of the second embodiment having the above-described configuration, the same advantages as those of the first embodiment can be acquired. In addition, since the pressurization of the ink and the decompressing and defoaming of the ink are performed together in the decompression defoaming chamber 130, a great amount of the air bubbles can be eliminated within a short time.

C. Third Embodiment

Figure 6:
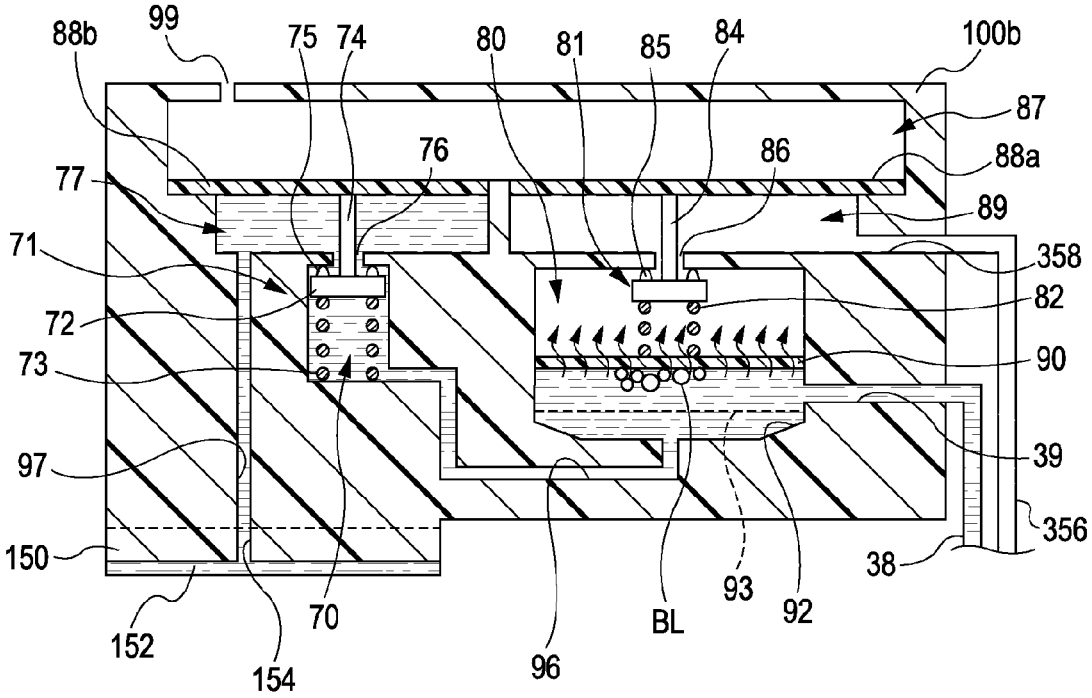
FIG. 6 is a cross-sectional view showing the internal structure of a carriage and a record head according to a third embodiment of the invention.

FIG. 6 is a cross-sectional view showing the internal structure of a carriage 100*b* and a record head 150 according to a third embodiment of the invention. A printer of the third embodiment is different from the printer 500 (FIGS. 1 to 3) in three points described below, and other configurations are the same as those of the first embodiment. In the third embodiment, an internal flow path 39 is communicated with a defoaming chamber 92, an internal flow path 96 that is disposed from a decompression chamber 92 to a valve chamber 70 is arranged instead of the ink ejecting flow path 95, and an ink ejecting flow path 97 that is disposed from an ink discharge opening of a first compression chamber 77 to a record head 150 is arranged instead of the internal flow path 79, which are different from the first embodiment.

In the first embodiment, the third valve 71 is disposed on the upstream side relative to the defoaming chamber 92. However, in the third embodiment, a third valve 71 is disposed on the downstream side relative to the defoaming chamber 92. The ink supplied to the carriage 100 from an ink supply unit 400, first, is supplied to the defoaming chamber 92 through the internal flow path 39 and is defoamed. Then, when the third valve 71 is in the valve opening state due to ejection of the ink, ink of the consumed amount flows into the first compression chamber 77 from the defoaming chamber 92 through an internal flow path 96.

According to the printer of the third embodiment having the above-described configuration, the same advantages as those of the first embodiment can be acquired. In addition, since the pressurization of the ink and the decompressing and defoaming of the ink are performed together in the defoaming chamber 92, a great amount of the air bubbles can be eliminated within a short time.

D. Fourth Embodiment

Figure 7:
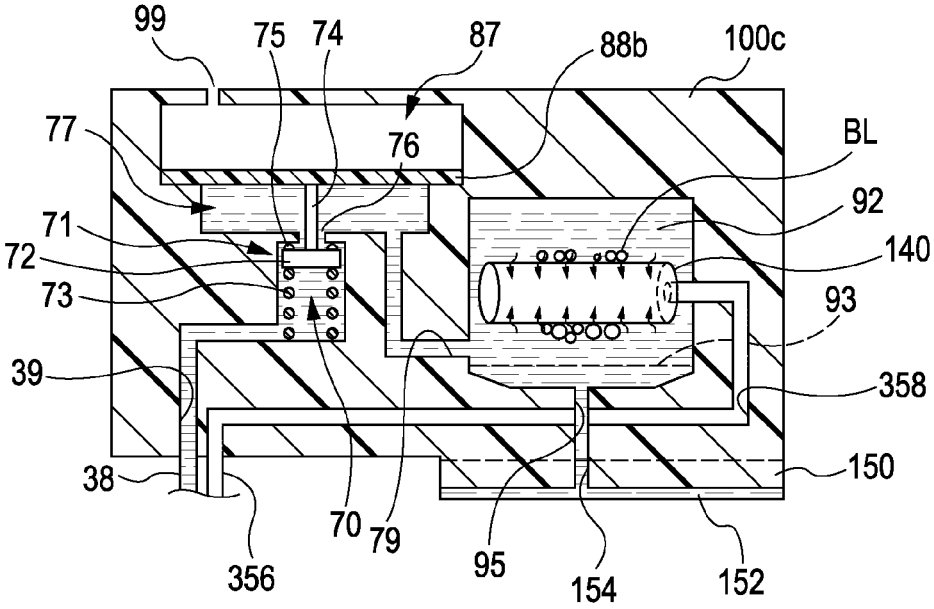
FIG. 7 is a cross-sectional view showing the internal structure of a carriage and a record head according to a fourth embodiment of the invention.

FIG. 7 is a cross-sectional view showing the internal structure of a carriage 100*c* and a record head 150 according to a fourth embodiment of the invention. A printer of the fourth embodiment is different from the printer 500 (FIGS. 1 to 3) in that a decompression tube 140 is included instead of the second compression chamber 89, the atmospheric pressure valve 81, and the decompression chamber 80, and the other configurations are the same as those of the first embodiment.

In the first embodiment, the chamber (the decompression chamber 80) that is decompressed for defoaming is brought into contact with the defoaming chamber 92. However, in the fourth embodiment, such a chamber (the decompression tube 140) is not brought into contact with the defoaming chamber 92. In particular, the decompression tube 140 is disposed on the upper side of the filter 93 inside the defoaming chamber 92. This decompression tube 140 is a hollow cylinder-shaped chamber, and the wall faces thereof have gas permeability. The decompression tube 140 is communicated with a negative-pressure supplying path 358. In addition, negative pressure is supplied to the decompression tube 140 from the ink supply unit 400. Then, when the negative pressure is supplied to the inside of the decompression tube 140, gas contained in the defoaming chamber 92 flows into the decompression tube 140, and defoaming is performed.

According to the printer of the fourth embodiment having the above-described configuration, the same advantages as those of the first embodiment can be acquired.

E. Modified Examples

In addition, elements from among constituent elements, which have been described in each of the above-described embodiments, other than elements claimed in an independent claim are not essential elements and may be appropriately omitted. In addition, the invention is not limited to the above-described embodiments or examples and may be implemented in various forms within the scope of the invention without departing from the basic idea. For example, the following modifications can be made therein.

E1. Modified Example 1

In each of the above-described embodiments, the negative-pressure generating unit 300 is commonly used for the pressurization of ink and the decompressing and defoaming of the ink. However, a configuration in which two negative-pressure generating units for each purpose are disposed may be used. In addition, in each of the above-described embodiments, the negative-pressure generating unit 300 is commonly used for all the colors (black, cyan, magenta, and yellow). However, a configuration in which the negative-pressure generating units 300 are disposed for each color may be used. In addition, the ink supply units 400 to 403 are disposed for each color in each of the above-described embodiments. However, one ink supplying unit may be commonly used for all the colors.

E2. Modified Example 2

In each of the above-described embodiments, in order to form the ink supply unit 400, the first flow path forming member 10 that is configured by the same member, the second flow path forming member 12 that is configured by the same member, and the flexible member 14 that is configured by the same member are used. However, the invention is not limited thereto. For example, the first valve 420, the pump 440, and the second valve 460 may be formed by using different members.

E3. Modified Example 3

In each of the above-described embodiments, as the configuration for supplying ink of each color to the carriage 100 from the ink cartridges IC1 to IC4, a configuration in which ink of each color is sucked from the ink cartridges IC1 to IC4 and is ejected by using the ink supply units 400 to 403 is used. However, a configuration in which pressured air is supplied to the inside of the ink cartridges IC1 to IC4 may be used. Even in such a configuration, the pressurized ink can be supplied to the carriage 100. In other words, generally, any arbitrary pressurization unit that can pressurize at least a part of the liquid supply path can be used in a liquid ejecting apparatus according to an embodiment of the invention.

E4. Modified Example 4

In each of the above-described embodiments, the types of ink ejected by the printer are in four colors. However, instead of such a configuration, a configuration in which ink of an arbitrary number of types is ejected may be used. In addition, the printer according to each of the above-described embodiments is an off-carriage-type printer. However, instead of such a configuration, a so-called on-carriage-type printer in which the ink cartridge is mounted on the carriage may be used.

E5. Modified Example 5

In the first embodiment and the third embodiment described above, the number of the pressurization area and the number of the decompression defoaming area are one. However, the pressurization areas corresponding to any arbitrary number and the decompression defoaming areas corresponding to any arbitrary number may be arranged. For example, in the second embodiment, similar to the first embodiment, it may be configured that the second compression chamber 89 and the decompression chamber 80 are disposed, the defoaming operation is performed in the defoaming chamber 92 together with the decompression defoaming chamber 130, and two decompression defoaming areas are arranged. In addition, for example, in the first embodiment, it may be configured that a pressurizing pump is installed in the middle of the internal flow path 39, the ink supplied from the ink supply unit 400 is additionally pressurized, and two pressurization areas having different pressure levels are consecutively disposed.

E6. Modified Example 6

In each of the above-described embodiments, an ink jet printer has been described. However, the invention is not limited thereto and may be applied to any arbitrary liquid ejecting apparatus that ejects a liquid other than the ink. For example, the invention may be applied to an image recording apparatus such as a facsimile; a coloring material ejecting head that is used for manufacturing a color filter of a liquid crystal display, or the like; an electrode material ejecting apparatus that is used for forming the electrode of an organic EL (electroluminescence) display, an FED (field emission display), or the like; a liquid ejecting apparatus that ejects a liquid containing a bioorganic material that is used for manufacturing a bio chip; a test material ejecting apparatus as a precision pipette; a lubricant ejecting apparatus; a resin-solution ejecting apparatus; or the like. In addition, the invention may be applied to: a liquid ejecting apparatus that ejects a lubricant to a precision machine such as a clock or a camera in a pin-point manner; a liquid ejecting apparatus that ejects a transparent resin solution such as an ultraviolet-curable resin onto a substrate for forming a tiny hemispherical lens (optical lens) used in an optical communication element or the like; or a liquid ejecting apparatus that ejects an acid etching solution, alkali etching solution, or the like, for etching a substrate, or the like. Furthermore, the invention may be applied to any one of various liquid ejecting apparatuses that include a liquid ejecting head that eject tiny amounts of liquid droplets, or the like.

Here, the liquid droplet represents the shape of the liquid ejected from the liquid ejecting apparatus and includes the shape of a particle, a tear, or a lengthy piece of string. In addition, the liquid described here represents a material that the liquid ejecting apparatus can eject. For example, the liquid may be a material in the liquid phase and includes a liquid state having high or low viscosity, a material in the fluid phase such as sol, gel water, other inorganic solvent, organic solvent, liquid solution, liquid resin, or liquid metal (metal melt). In addition, the liquid includes not only a liquid as one phase of a material but also a material in which particles of a function material formed of a solid material, such as a pigment or a metal particle, is dissolved, dispersed, or mixed as a solvent. As major examples of the liquid, ink and liquid crystals are described in the embodiments above. Here, the ink includes general water-based ink, oil-based ink, and various types of liquid compositions such as gel ink or hot-melt ink.

What is claimed is:

1. A liquid ejecting apparatus that is used for ejecting a liquid, the liquid ejecting apparatus comprising:

a head unit that ejects the liquid;

a liquid supply path that is used for directing the liquid to the head unit;

a decompression defoaming unit that eliminates air bubbles from the liquid by decompressing at least a part of the liquid supply path, the decompression defoaming unit includes an atmospheric valve device;

a valve device that can seal the liquid supply path;

a boundary of an atmospheric chamber extending over a portion of the valve device and the atmospheric valve device; and a pressurizing unit that is disposed on an upstream side relative to the valve device and pressurizes the liquid in the liquid supply path between the pressurizing unit and the valve device, wherein the decompression defoaming unit includes a defoaming chamber that is used for eliminating the air bubbles contained in the liquid, wherein the defoaming chamber is disposed in the supply path between the pressurizing unit and the valve device.

2. The liquid ejecting apparatus according to claim 1, wherein the decompression defoaming unit includes a decompression chamber that is brought into contact with the defoaming chamber, and a pressure adjusting section that adjusts the pressure of the inside of the decompression chamber, and wherein gas can be permeated through a wall of the defoaming chamber that is brought into contact with the decompression chamber and a wall of the decompression chamber that is brought into contact with the defoaming chamber.

3. The liquid ejecting apparatus according to claim 2, wherein the wall of the defoaming chamber that is brought into contact with the decompression chamber and the wall of the decompression chamber that is brought into contact with the defoaming chamber are integrally formed.

4. The liquid ejecting apparatus according to claim 1, further comprising a pump mechanism, wherein the decompression defoaming unit and the pressurizing unit commonly use the pump mechanism.

5. The liquid ejecting apparatus according to claim 1, wherein the valve device selectively delivers the liquid to the head unit by opening and closing in accordance with consumption of the liquid.

6. The liquid ejecting apparatus according to claim 1, wherein the defoaming chamber communicates with the atmospheric pressure valve device, the atmospheric pressure valve device being actuated through a pressure differential between an atmospheric pressure chamber and a second compression chamber communicating with the atmospheric pressure valve device.

* * * * *